US011655530B2

(12) United States Patent
Chung et al.

(10) Patent No.: US 11,655,530 B2
(45) Date of Patent: May 23, 2023

(54) COPPER ALLOY TUBE FOR HEAT EXCHANGER WITH EXCELLENT THERMAL CONDUCTIVITY AND BREAKING STRENGTH AND METHOD OF MANUFACTURING THE SAME

(71) Applicant: LS METAL CO., LTD., Seoul (KR)

(72) Inventors: Ho Rim Chung, Seoul (KR); Chang Ho Oh, Gunsan-si (KR); Dae Kyong Kim, Gwangju (KR); Do Young Chung, Hwaseong-si (KR); Do Youl Lee, Seongnam-si (KR); Dong Jun Kwak, Seoul (KR)

(73) Assignee: LS METAL CO., LTD., Seoul (KR)

( * ) Notice: Subject to any disclaimer, the term of this patent is extended or adjusted under 35 U.S.C. 154(b) by 0 days.

(21) Appl. No.: 17/325,951

(22) Filed: May 20, 2021

(65) Prior Publication Data

US 2022/0042154 A1 Feb. 10, 2022

(30) Foreign Application Priority Data

Aug. 7, 2020 (KR) ..... 10-2020-0099118

(51) Int. Cl.

| | |
|---|---|
| ***C22C 9/02*** | (2006.01) |
| ***F28F 21/08*** | (2006.01) |
| ***C22F 1/08*** | (2006.01) |

(52) U.S. Cl.

CPC ..... *C22F 1/08* (2013.01); *C22C 9/02* (2013.01); *F28F 21/085* (2013.01)

(58) Field of Classification Search

CPC .. C22F 1/08; F28F 21/085; C22C 9/02; C22C 9/00

See application file for complete search history.

(56) References Cited

U.S. PATENT DOCUMENTS

| | | | | |
|---|---|---|---|---|
| 4,876,870 | A | 10/1989 | Rantanen | |
| 9,671,182 | B2 * | 6/2017 | Takagi | C22C 9/02 |
| 2011/0180244 | A1 * | 7/2011 | Finney | F28F 1/00 165/180 |
| 2017/0040081 | A1 * | 2/2017 | Kobayashi | C22C 9/04 |

FOREIGN PATENT DOCUMENTS

| | | | |
|---|---|---|---|
| CN | 101430175 | A | 5/2009 |
| CN | 101469961 | A | 7/2009 |
| EP | 2199693 | A1 | 12/2009 |
| EP | 2199693 | A1 | 6/2010 |
| GB | 1157658 | | 10/1967 |
| JP | 2003268467 | A | 9/2003 |

(Continued)

OTHER PUBLICATIONS

JP2008001933A, Kuroda H et al., published Jan. 2008. Machine translation. (Year: 2008).*

(Continued)

*Primary Examiner* — John A Hevey
(74) *Attorney, Agent, or Firm* — K&L Gates LLP

(57) ABSTRACT

The present disclosure relates to a copper alloy tube for a heat exchanger having excellent breaking strength and a method of manufacturing the same, and more particularly, to a Cu alloy tube having excellent breaking strength and thermal conductivity and suitable for use in a heat exchanger, and a method of manufacturing the same.

6 Claims, 1 Drawing Sheet

(56) References Cited

FOREIGN PATENT DOCUMENTS

| | | | | |
|---|---|---|---|---|
| JP | 2008001933 | A | * | 1/2008 |
| JP | 2011225989 | A | | 11/2011 |
| JP | 2013076123 | A | | 4/2013 |
| KR | 20090041333 | A | | 4/2009 |
| KR | 20120104582 | A | | 9/2012 |

OTHER PUBLICATIONS

Korean Notice of Allowance for related Korean Application No. 10-2020-0099118; action dated Feb. 2, 2021; (7 pages).
Korean Office Action for related Korean Application No. 10-2020-0099118; action dated Oct. 23, 2020; (10 pages).
Korean Office Action for related Korean Application No. 10-2020-0099118; action dated Jan. 11, 2021; (4 pages).
Zhang; "Casting alloys and their smelting (Chinese Edition)"; Huazhong University of Science and Technology Press; Apr. 30, 2021; (4 pages).

* cited by examiner

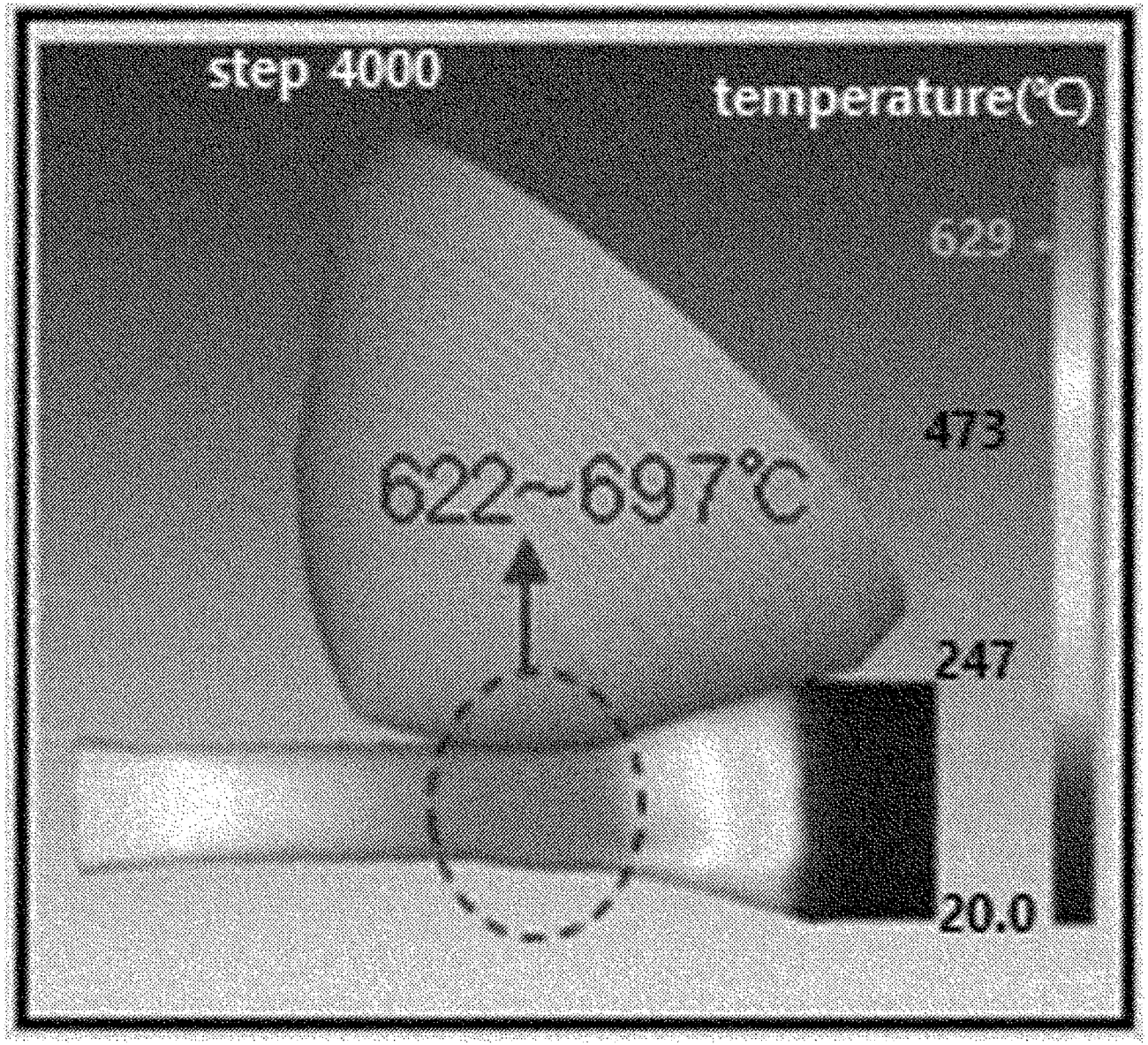
step 4000
temperature(°C)
629
475
627~697°C
247
20.0

COPPER ALLOY TUBE FOR HEAT EXCHANGER WITH EXCELLENT THERMAL CONDUCTIVITY AND BREAKING STRENGTH AND METHOD OF MANUFACTURING THE SAME

CROSS-REFERENCE TO RELATED APPLICATIONS

Pursuant to 35 U.S.C. § 119(a), this application claims the benefit of earlier filing date and right of priority to Korean Application No. 10-2020-0099118, filed on Aug. 7, 2020, in the Korean Intellectual Property Office, the disclosure of which is incorporated herein in its entirety by reference.

FIELD

The present disclosure relates to a copper alloy tube for a heat exchanger having excellent thermal conductivity and breaking strength, and a method of manufacturing the same, and more particularly, to copper alloy tubes having excellent breaking strength and thermal conductivity, and suitable for use in heat exchangers, and a method of manufacturing the same.

BACKGROUND

In order to prevent ozone layer destruction and global warming, the use of refrigerants is regulated in the Montreal Protocol and the Kyoto Protocol. A CFC refrigerant, which is a first generation refrigerant, has been prohibited from being produced and sold due to an ozone layer destruction problem, and as a second generation HCFC refrigerant has a slight ozone depletion problem but causes a global warming problem, it is expected to be totally abolished by 2030. Among the second generation refrigerants, R22 is still used in many household air conditioners. HFCs, which are third generation refrigerants, are expected to be reduced due to the problem of global warming. Among HFC refrigerants, R410A is widely used in system air conditioners. Domestic and foreign air conditioner manufacturers have developed and applied natural refrigerants, HFO series and HCFC series refrigerants, instead of HFC series refrigerants whose use is expected to be prohibited by 2030 according to Montreal Protocol and the Kyoto Protocol, but have the disadvantage of high operating pressure. In the case of HFCF-based R22 among these refrigerants, the operating pressure is about 1.8 MPa, the operating pressure of HFC system R410A is 3 MPa and the operating pressure of $CO_2$ as a natural refrigerant is about 7 to 10 MPa. Heat exchangers produced by air conditioner manufacturers are generally made of aluminum fins and copper tubes bent into hairpin shapes. The copper tube used in the heat exchanger should be well machined into a hairpin shape and have good solderability. In addition, high thermal conductivity and electrical conductivity are required for good heat exchange performance. For such characteristics, phosphorus-deoxidized copper is widely used. The phosphorus-deoxidized copper is Deoxidized High Phosphorus (DHP) copper in which 150 ppm to 400 ppm of P as a deoxidizing agent is added to copper to remove oxygen. When an HFC-based heat refrigerant, an HFO-based refrigerant or a natural refrigerant is applied to a heat exchanger using phosphorus-deoxidized copper, as the operating pressure increases, the thickness must be increased in order to increase strength. In addition, since the crystal grains are coarsened by the heat of the soldered portion and the material changes from hard to soft, the thickness must be increased, and when the thickness is increased, the weight of the copper tube used in the heat exchanger is increased, thereby increasing the cost of the exchanger. Rather than increasing the cost thereof by increasing the thickness of the copper tube used in a heat exchanger, a method of increasing strength by making a copper tube of an alloy has been proposed. As the Co—P system, a seamless copper alloy tube for heat exchange ventilation containing 0.02 to 0.2% of Co, 0.01 to 0.05% of P, and 1 to 20 ppm of C, and oxygen of impurities is regulated, and as the Sn—P system, a copper alloy tube for heat exchangers containing 0.1 to 1.0% of Sn and 0.005 to 0.1% of P and having a composition in which Zn is selectively added are proposed. In order to increase the breaking strength of such copper alloy tubes, the method of adding an alloy element causes a phenomenon in which thermal conductivity and electrical conductivity are lowered by the alloy element, and the higher the content of the alloying element to be added, the worse the thermal conductivity and electrical conductivity. In particular, the P component has a sensitive effect on electrical conductivity. Since P is used as a deoxidizing agent, it is known that when the content of the P component is lowered, the concentration of oxygen in the copper tube is increased, an oxide of P is generated and the soundness of the cast billet is lowered. Further, in the case of an air conditioner manufactured with a heat exchanger, corrosion occurs due to temperature, humidity, and corrosion factors in a use environment, a storage environment, a manufacturing process, and the like. During the corrosion of the air conditioner, the leakage of the refrigerant due to the corrosion of the heat exchanger through which the refrigerant circulates leads to an air conditioner malfunction and a product exchange service. This corrosion phenomenon is known to occur specifically within a period of 2-3 months after installation of the product, and it is said that this type of corrosion is similar to that of an ant nest and is called "ant nest corrosion". Since it is known that corrosion resistance against such an ant nest corrosion phenomenon is higher in oxygen-free copper than phosphorus-deoxidized copper, there is also an attempt to apply oxygen-free copper in manufacturing a heat exchanger.

SUMMARY

The present disclosure has been made to solve the above problems, and a first object of the present disclosure is to provide a copper alloy tube which has excellent breaking strength even in a thin thickness and excellent thermal conductivity and is suitable for use in a heat exchanger. A second problem to be solved by the present disclosure is to provide a manufacturing method that enables a copper alloy tube to have the above-mentioned physical properties.

In order to solve the above-mentioned first problem, the present disclosure provides a copper alloy tube for a heat exchanger comprising an oxygen-free copper-tin alloy having an oxygen (O) content of 1 to 20 ppm, a composition satisfying the following conditional formulas (1) and (2), a thermal conductivity of 260 to 350 W/m·K, and an electrical conductivity of 65% IACS or more.

$$0.1\text{ wt }\% \le C_{Sn} \le 3.0\text{ wt }\% \quad 1)$$

$$C_P/C_{Sn} \le 0.01 \quad 2)$$

In the above conditional formula 1, $C_P$ and $C_{Sn}$ each represent the content of phosphorus and tin in the oxygen-free copper-tin alloy.

In a preferred embodiment of the present disclosure, the oxygen-free copper-tin alloy may further satisfy the following condition 3).

$$10^{-4}\text{ wt }\% \le C_P \le 0.005\text{ wt }\%. \quad 3)$$

In a preferred embodiment of the present disclosure, the oxygen-free copper-tin alloy may not contain phosphorus.

In a preferred embodiment of the present disclosure, the oxygen-free copper-tin alloy may have a tin content of 0.3 to 0.6 wt %.

In a preferred embodiment of the present disclosure, the oxygen-free copper-tin alloy may comprise 5 to 10 ppm of oxygen.

In a preferred embodiment of the present disclosure, the oxygen-free copper-tin alloy may further comprise the following i) or ii):

i) 0.01-1.0 wt % of zinc (Zn)

ii) at least one metal selected from the group consisting of iron (Fe), nickel (Ni), manganese (Mn), magnesium (Mg), chromium (Cr), titanium (Ti), zirconium (Zr) and silver (Ag) included in a total amount of up to 0.07 wt %.

In a preferred embodiment of the present disclosure, the copper alloy tube for a heat exchanger may have a tensile strength of 260 MPa or more in a longitudinal direction of the tube.

In a preferred embodiment of the present disclosure, the oxygen-free copper-tin alloy may have a texture having a GOSS orientation distribution density of 4.5% or less, more preferably 0.1 to 1.5%.

In order to solve the second problem described above, the present disclosure relates to a method of manufacturing a copper alloy tube for a heat exchanger, the method comprising melting, casting and rolling steps:

in the melting and casting step, the content of phosphorus (P) comprised in the molten metal of the oxygen-free copper-tin alloy is set to be 0.005 wt % or less, and a shielding layer is formed on the molten metal so that the molten metal is not exposed to oxygen in the air, thereby performing melting and casting.

In a preferred embodiment of the present disclosure, the rolling step may be performed by hot rolling in which a maximum temperature of a rolled portion is 600 to 750° C.

The copper alloy tube for a heat exchanger according to the present disclosure can maintain the same level of breaking strength as conventional phosphorus-deoxidized copper even at a small thickness, and can achieve better thermal conductivity and electrical conductivity, and has the advantage of significantly improved corrosion resistance against ant-nest corrosion.

In addition, according to the method of manufacturing a copper alloy tube for a heat exchanger of the present disclosure, it is possible to significantly lower the content of the deoxidizing agent in the alloy, in particular, the phosphorus content, and to effectively remove oxygen, thereby manufacturing copper alloy tubes having excellent thermal conductivity and electrical conductivity and excellent breaking strength even with a small thickness, which are suitable for use in heat exchangers.

BRIEF DESCRIPTION OF THE DRAWINGS

FIG. 1 is an enlarged view of a portion where a hollow billet of an oxygen-free copper-tin alloy according to the present disclosure is rolled, and the temperature of each portion is displayed by changing color by temperature.

DETAILED DESCRIPTION

Before the present disclosure is described in detail, the meaning of terms used herein will be described. As used herein, "melt" refers to a liquid metal that is melted to produce an alloy. In the present specification, the "rolling site" means a local site where rolling is performed by bringing a rolling mill into contact with an intermediate material such as a billet formed by casting a molten metal.

Hereinafter, the present disclosure will be described in more detail. As described above, the conventional copper alloy tube for a heat exchanger has a problem in that thermal conductivity and electrical conductivity are lowered by using phosphorus-deoxidized copper, and corrosion resistance against ant nest corrosion is poor. The present inventors have sought to solve these problems by providing a copper alloy tube for a heat exchanger comprising an oxygen-free copper-tin alloy having an oxygen (O) content of 1 to 20 ppm, a composition satisfying the following conditional formulas (1) and (2), a thermal conductivity of 260 to 350 W/m·K, and an electrical conductivity of 65% IACS or more.

$$0.1\text{ wt }\% \le C_{Sn} \le 3.0\text{ wt }\% \quad 1)$$

$$C_P/C_{Sn} \le 0.01 \quad 2)$$

In the above conditional formula 1, $C_P$ and $C_{Sn}$ each represent the content of phosphorus and tin in the oxygen-free copper-tin alloy.

The copper alloy tube for a heat exchanger according to the present disclosure has the advantage in that the use of an oxygen-free copper-tin alloy having impurities satisfying the above-mentioned conditions in the copper alloy tubes for heat exchangers makes the thermal conductivity and electrical conductivity of the copper alloys remarkably superior to those of conventional copper alloys, and from this, it is possible to reduce the thickness of the copper alloy tubes for heat exchangers, thereby reducing manufacturing costs.

Tin (Sn) has an effect of improving tensile strength and heat resistance through an alloy with copper and suppressing the coarsening of crystal grains, and can be used in a heat exchanger using new refrigerants and natural refrigerants having a high operating pressure. When the content of tin exceeds 3.0 wt %, thermal conductivity decreases, and segregation occurs during casting, resulting in a problem that the mechanical properties become uneven.

The content of tin may preferably be 0.3-0.6 wt %. When the content of tin is 0.3 wt % or more, tensile strength is more excellent, and when the content is 0.6 wt % or less, thermal conductivity and electrical conductivity are more excellent. Therefore, the content of tin is preferably 0.3 to 0.6 wt %.

More specifically, the content of phosphorus as a deoxidizing agent can be adjusted to low content of 0.005 wt % or less. More preferably, the $C_P$ further satisfies the following condition 3).

$$10^{-4}\text{ wt }\% \le C_P \le 0.005\text{ wt }\%. \quad 3)$$

When the above condition 2) is satisfied, the copper alloy tube for a heat exchanger of the present disclosure has the advantage of having better tensile strength and thermal conductivity and electrical conductivity. Phosphorus is an effective component for removing oxygen from the molten metal of the copper alloy and preventing oxidation of tin, but there is a problem in that the higher the phosphorus content, the lower the performance of the electric conductivity and thermal conductivity of the copper alloy. In the present disclosure, instead of adjusting the phosphorus content to a minimum, the oxygen of the molten copper alloy can be removed by the process features to be described below, so that a copper alloy tube having significantly improved thermal conductivity and electrical conductivity compared to that of phosphorus-deoxidized copper can be realized.

Further, preferably, the oxygen-free copper-tin alloy may be one that does not contain phosphorus. In the case of containing no phosphorus, the thermal conductivity and electrical conductivity of the copper alloy can be further improved.

Although the thermal conductivity and electrical conductivity of the copper alloy can be further improved in the case of containing no phosphorus, it is preferable to adjust the phosphorus content to the same range as the above condition 2) from the viewpoint of cost reduction rather than producing a copper alloy melt having a completely zero phosphorus content in the process.

The texture of the copper alloy differs depending on the manufacturing process, conditions, and heat treatment method, but the copper-alloy tube of the present disclosure usually has a texture (aggregate texture) in which the main angular orientations such as the Cube orientation, Goss orientation, Brass orientation (also referred to as B orientation), Copper orientation (hereinafter referred to also as Cu orientation), and S orientation are randomly present without the presence of a large number of crystal faces of a specific orientation. Among these, in particular, although only the Goss orientation greatly affects the breaking strength, and the other angular orientations are somewhat different from each other, this does not affect the breaking strength as much as the Goss orientation. The amount (orientation distribution density) of the Goss orientation crystal plane (crystal grains), which is inevitably present in the texture of the Cu—Sn copper alloy, is never large because of the "random texture". However, even in a slight amount, the Goss orientation in the Sn—P-based copper alloy tube assembly structure adversely affects the breaking strength of the copper alloy tubes. That is, when the orientation distribution density of the Goss orientation in the "random texture" of the Sn—P-based copper alloy tube becomes a certain degree or more, the generation of cracks in the heat exchanger copper alloy tube with respect to the tensile force applied in the circumferential direction of the heat exchange copper alloy tubes is promoted and the tensile strength of the copper alloy tubes is significantly lowered.

In terms of the characteristics of crystal grains in each orientation in the texture, a crystal grain having a Goss orientation has a theoretically infinitely large r value (value of plastic strain ratio) in the circumferential direction of the tube, which is a direction perpendicular to the tube longitudinal direction (direction of extruding the tube). Therefore, a crystal grain having a Goss orientation cannot reduce the tube thickness in the tube circumferential direction. In other words, crystal grains having a Goss orientation in the texture of the copper alloy tube cannot reduce the tube thickness in the tube circumferential direction. In other words, when the number of crystal grains having a Goss orientation in the texture of the copper alloy tube is large, the balance between the tensile strength ($\sigma_T$) and the elongation ($\delta$) in the tube circumferential direction is destroyed, and elongation deformation ability in the tubular circumferential direction decreases. As a result, the deformation in the circumferential direction of the tube is less likely to occur with respect to the tensile force applied to the tube circumferential direction, and cracks are generated in the tube, thereby increasing the possibility of breaking.

On the other hand, the copper alloy tube according to the present disclosure has a texture in which the GOSS orientation distribution density of a copper alloy is 4.5% or less, so that the balance between the tensile strength and the elongation in the circumferential direction of the tube can be enhanced to enhance elongation deformation ability in the direction of tube circumference. As a result, the copper alloy tube is easily deformed in the circumferential direction of the tube by the tensile force applied in the tube circumferential direction, and cracks are less likely to be generated (the time for the generation of cracks is delayed), and the tensile strength of the Cu alloy tube can be increased. More preferably, the copper alloy has a GOSS orientation distribution density of the texture of 0.1 to 1.5%.

In a preferred embodiment of the present disclosure, the copper alloy tube for a heat exchanger further comprises the following i) or ii):

i) 0.01-1.0 wt % of zinc (Zn)

ii) at least one metal selected from the group consisting of iron (Fe), nickel (Ni), manganese (Mn), magnesium (Mg), chromium (Cr), titanium (Ti), zirconium (Zr) and silver (Ag) comprised in a total amount of not more than 0.07 wt %.

When zinc (Zn) is added to a copper alloy, it has an effect of improving strength, fatigue strength, and the like without significantly decreasing the thermal conductivity of the copper alloy. In addition, there is an effect of extending the life of the tool. When the content of zinc is more than 1.0 wt %, the susceptibility to stress corrosion cracking becomes high, and the tensile strength in the longitudinal direction or the circumferential direction of the tube decreases, resulting in a problem of decreasing breaking strength. In contrast, when the content of zinc is less than 0.01 wt %, there is a problem of the effect of addition not being exhibited.

In addition, all of the above-mentioned iron (Fe), nickel (Ni), manganese (Mn), magnesium (Mg), chromium (Cr), titanium (Ti), zirconium (Zr), and silver (Ag) serve to improve the strength, the pressure resistance breaking strength and micro heat resistance of the copper alloy and to refine the crystal grains. However, when the total amount of their contents is more than 0.07 wt %, the processability of the copper alloy is poor, and defects on the surface are easily generated, which makes it difficult to manufacture a thin copper tube. Therefore, when the above elements are selectively contained, it is preferable to comprise only one or two or more element(s) selected from the group consisting of iron, nickel, manganese, magnesium, chromium, titanium, zirconium and silver in a total content of 0.07 wt % or less.

The copper alloy comprises 1 to 20 ppm of oxygen (O). Since oxygen is contained as an impurity in the metal to form an oxide, the mechanical and electrical properties of the copper alloy may be deteriorated and defects may be generated when the oxide is comprised in a large amount, so that oxygen must be sufficiently removed through the deoxidation process. Oxygen is preferably comprised in an amount of 20 ppm or less, and when it is to be removed to be contained at less than 1 ppm, the process cost is excessively increased while the increase in the effect of removing oxygen is slight, which is not preferable from the economic viewpoint. More preferably, the copper alloy may comprise 5 to 10 ppm of oxygen (O).

The copper alloy tube of the present disclosure preferably has a tensile strength of 260 MPa or more in the longitudinal direction. The tensile strength of existing copper alloy tubes for heat exchangers is generally 205 to 250 MPa after heat treatment. In the case of the Sn-based copper alloy tube according to the present disclosure, since tin is added in order to obtain a tensile strength higher than that of an existing phosphorus-deoxidized copper tube, it is effective only when the tensile strength is higher than 250 MPa, which is a tensile strength of an existing phosphorus-deoxidized copper tube. When the tensile strength after heat treatment is 260 MPa or more, it can be said that it is usable for a heat exchanger to which a new refrigerant or a natural refrigerant is applied, and more preferably, the tensile strength is 270 MPa or more.

The copper alloy tube for a heat exchanger according to the present disclosure has an electrical conductivity of 65% IACS or more and a thermal conductivity of 260 to 350 W/m·K. The electrical conductivity of a conventional Sn—P based phosphorus-deoxidized copper shows an electrical conductivity of about 60% IACS. The copper alloy tube according to the present disclosure can achieve a higher electrical conductivity than the phosphorus-deoxidized copper by significantly lowering the phosphorus content that affects electrical conductivity. Furthermore, the copper alloy tube according to the disclosure preferably has an electrical conductivity of at least 70% IACS.

When the thermal conductivity is 260 to 350 W/m·K, in the case of using the copper alloy tube in a heat exchanger, heat can be smoothly transferred to improve the performance of the heat exchanger. Therefore, the copper alloy tube for a heat exchanger according to the present disclosure has the advantages of reducing the thickness thereof, and by virtue of having the excellent tensile strength as described above, it is resistant to breakage or the like at the operating pressure, and costs can be greatly reduced.

A copper alloy tube having the above-mentioned characteristics is manufactured according to the following manufacturing method. Hereinafter, portions overlapping with the contents described in the above-mentioned copper alloy tube will be omitted.

The copper alloy tube according to the present disclosure is a method of manufacturing a copper alloy tube for a heat exchanger, the method comprising including melting, casting and rolling steps:

In the melting and casting step, the content of phosphorus (P) comprised in the molten metal of the oxygen-free copper-tin alloy is set to 0.005 wt % or less, and a shielding layer is formed on the molten material so that the molten metal is not exposed to air, and thus melting and casting are performed.

This has the advantage of being able to perform deoxidation by the shielding layer instead of adjusting the phosphorus content to a minimum, so that a copper alloy tube in which deterioration of thermal conductivity and electrical conductivity due to phosphorus is suppressed can be manufactured.

Specifically, electrolytic copper as a raw material is melted in a melting furnace, and tin is added to the molten copper to prepare a molten copper-tin alloy. At this time, the added content of tin is the same as described above, and therefore, description thereof is omitted.

At this time, a coating material of a carbon (C) component is applied to the surface of the melt to form a shielding layer in order to block the contact between the melt and the outside air. The coating material may preferably be at least one selected from graphite granules, charcoal, graphite powder and a reducing flux. The coating material may more preferably be graphite granules.

The shielding layer is preferably formed to a thickness of 5 to 20 cm. When the thickness of the shielding layer is less than 5 cm, the contact between the molten metal and the air may not be sufficiently blocked, so that the deoxidizing action may not properly occur. In addition, when the thickness of the shielding layer exceeds 20 cm, an excessive amount of coating material is used such that the process cost is increased, and there is no additional advantage in terms of effect.

When the components of the melt are stabilized, the melt is transferred to a casting furnace and continuously cast in the form of a hollow billet. Similar to melting, during the continuous casting, contact with the atmosphere is eliminated so that oxygen in the melt does not increase.

The casting step is preferably carried out with a horizontal continuous casting method so as to have the form of a hollow billet.

Further, in the present disclosure, unlike the conventional extrusion process method of manufacturing a copper alloy tube, the hollow billet can be rolled into a copper tube shape.

Preferably, the rolling step may be carried out in a hot rolling manner in which the rolling zone is heated by friction, and the rolling temperature is preferably the maximum rolling zone temperature of 600 to 750° C. This is higher than the recrystallization temperature of the oxygen-free copper-tin alloy, so that the processability of the process after rolling is improved.

Preferably, the rolling process is performed by rotating a plurality of rolls around the hollow billet. When rolling is performed in this manner, the heat treatment proceeds by the frictional heat generated during rolling, and the temperature can be raised to the recrystallization temperature. During the rolling step, the GOSS orientation distribution density can be lowered to 4.5% or less.

Referring to FIG. 1, it can be confirmed that the temperature in the rolling zone is heated to a maximum temperature of 600° C. to 750° C. by friction between the roller and the hollow billet. Since the copper alloy tube is heated to such a high temperature to cause recrystallization and has a structure having the Goss orientation distribution density as described above, a copper alloy tube having excellent tensile strength can be obtained.

A heat treatment may be additionally performed after the above steps. When the heat treatment is performed, a copper alloy tube having soft or semi-soft properties can be manufactured.

The above heat treatment temperature can be preferably carried out at a temperature of 450° C. or more, and the heat treatment time can be 1 minute or more for sufficient formation of a recrystallized structure. However, when the heat treatment time exceeds 120 minutes, after the recrystallization completely takes place, coarsening of the crystal grains may proceed, and therefore, heat treatment may be performed for 1 to 120 minutes.

The present disclosure will now be described in more detail by way of examples. However, the following embodiments are not meant to limit the scope of the present disclosure, and those skilled in the art will be able to add, delete, and change configurations within the spirit of the disclosure and implement the embodiments without difficulty.

Example 1

Tin was added to a copper melt using electrolytic copper as a raw material so as to become 0.5409 wt %, graphite granules were applied to the upper part of the copper melt to form a shielding layer, and casting was performed by continuous casting at a casting temperature of 1,200° C. to produce a hollow billet having a diameter of 90 mm and a thickness of 25 mm.

A mandrel was inserted into the inner surface of the hollow billet and rolling was performed to manufacture a rolled mother tube. A copper alloy tube having an outer diameter of 12.7 mm and a thickness of 0.6 mm was manufactured by repeating the drawing out process of the rolled mother tube to a reduction in cross section of 45% or less. The resultant was heat-treated at a temperature of 450 to 600° C. under a reducing atmosphere to manufacture a soft Sn-based copper alloy tube.

Examples 2 to 5

Soft Sn-based copper alloy tubes were manufactured in the same manner as in Example 1, but the tin content in the melt was adjusted as shown in Table 1.

Comparative Examples 1 and 2

Soft Sn-based copper alloy tubes were manufactured in the same manner as in Example 1, but the contents of phosphorus and tin in the melt were adjusted as shown in Table 1 below.

The copper (including impurities), phosphorus, tin, and oxygen concentrations of the molten metal thus prepared were measured, and are shown in Table 1 below.

| Item | Cu (wt %) | P (ppm) | Sn (ppm) | O (ppm) | Electrical Conductivity (% IACS) |
|---|---|---|---|---|---|
| Example 1 | 99.38 | 1 | 5409 | 7.1 | 71.1 |
| Example 2 | 99.25 | 1 | 6597 | 13.4 | 66.9 |
| Example 3 | 99.53 | 1 | 1958 | 9.2 | 68.4 |
| Example 4 | 99.44 | 1 | 4928 | 11.7 | 71.9 |
| Example 5 | 99.42 | 10 | 5047 | 10.1 | 71.0 |
| Comparative Example 1 | 99.95 | 301 | 6 | 8.1 | 81.4 |

-continued

| Item | Cu (wt %) | P (ppm) | Sn (ppm) | O (ppm) | Electrical Conductivity (% IACS) |
|---|---|---|---|---|---|
| Comparative Example 2 | 99.54 | 167 | 4310 | 9.1 | 64.5 |

In Table 1, the content of Cu represents the content including inevitable impurities.

Experimental Example 1: Tensile Test

The tensile strength of the copper alloy tube manufactured in the above Example 1, Comparative Example 1 and Comparative Example 2 was measured by preparing a test piece by cutting out a tube portion with the test piece method of No. 11 in the KS B 0801 (Test Specimen of Metal for Tensile Test), and inserting a center portion into a bite portion, and carrying out a tensile strength test according to the tensile test method of KSB 0802 for a metal material. The results of tensile test are shown in Table 2 below.

TABLE 2

| | Mechanical Properties | | |
|---|---|---|---|
| Item | Tensile Strength ($N/mm^2$) | Elongation (%) | Breaking strength (MPa) |
| Example 1 | 269 | 50 | 23.9 |
| Comparative Example 1 | 237 | 45 | 21.0 |
| Comparative Example 2 | 276 | 49 | 24.1 |

The tensile strength of the copper alloy tube of the present disclosure was 269 $N/mm^2$, showing a level superior to that of the phosphorus-deoxidized copper tube of Comparative Example 1 having a tensile strength of 237 N/mm2 and similar to that of the Sn—P-based copper alloy tube of Comparative Example 2.

Experimental Example 2: Microtissue Observation

The crystal grain size and the orientation distribution density of the GOSS orientation of the copper alloy tubes manufactured according to Example 1, Comparative Example 1 and Comparative Example 2 were measured and compared. The GOSS orientation distribution density was measured using a scanning electron microscope (SEM). The results are shown in Table 3 below.

TABLE 3

| Item | Crystal grain size (mm) | GOSS orientation distribution density (%) | Electrical conductivity (% IACS) | Thermal conductivity (W/m · K) |
|---|---|---|---|---|
| Example 1 | 0.0020 | 1.4 | 71.1 | 295 |
| Comparative Example 1 | 0.0041 | 1.9 | 81.4 | 338 |
| Comparative Example 2 | 0.0021 | 4.2 | 64.5 | 249 |

Referring to Table 3, it was confirmed that the copper alloy tube according to Example 1 of the present disclosure had a GOSS orientation distribution density of 1.4%, which is in a range of 4.5% or less required for increasing the breaking strength. In addition, the copper alloy tube according to Example 1 has a GOSS orientation distribution density of 1.4%, which is included in the range of 0.1 to 1.5%, and thus can have more excellent tensile strength.

Experimental Example 3: Breaking Strength

A 300-mm copper alloy tube was sampled for testing from the copper alloy tubes manufactured according to Example 1, Comparative Example 1 and Comparative Example 2, one end portion was closed with a bolt, and the water pressure was gradually increased in the tube from the open end portion of the other side by a pump, and then the pressure at the time of complete rupture was measured to obtain the breaking strength. The measured results are shown in Table 2 above.

Referring to Table 2 above, regarding breaking strength, it was found that the copper alloy tube of Example 1 had a similar tendency with the Sn—P-based copper alloy tube of Comparative Example 2, similar to the tensile strength.

Experimental Example 4: Measurement of Thermal Conductivity and Electrical Conductivity The electrical conductivity of the copper alloy tube manufactured according to Examples and Comparative Examples was measured using a double bridge method by cutting out 700 mm from each copper alloy tube. The results are shown in Table 1 above. The results of Example 1, Comparative Example 1 and Comparative Example 2 are also shown in Table 3.

In addition, the thermal conductivity of the copper alloy tube manufactured according to Example 1, Comparative Example 1, and Comparative Example 2 was measured based on the method for measuring thermal conductivity of ASTM E1461-13. The results are shown in Table 3.

The copper alloy tube of Example 1 having low P content of the present disclosure had an electrical conductivity measured to be about 71.1% IACS, the electrical conductivity of the Sn—P based copper alloy tube of Comparative Example 1 was measured to be about 64.5% IACS, and the copper alloy tube of Comparative Example 2, which is phosphorus deoxidized copper, was measured as having an electrical conductivity of about 81.4% IACS. In addition, the thermal conductivity of the copper alloy tubes according to Example 1, Comparative Example 1 and Comparative Example 2 was 295 W/m·K, 249 W/m·K and 338 W/m·K, respectively, and it was confirmed from this that there was the same tendency between electrical conductivity and thermal conductivity, and that the drop in thermal conductivity and electrical conductivity could be minimized while the copper alloy tube according to the present disclosure had high strength.

Experimental Example 5: Corrosion Resistance

The copper alloy tubes manufactured according to Example 1, Comparative Example 1 and Comparative Example 2 were tested by the KS D9502:2009 salt spray test method. Two identical test pieces per test piece were fabricated and tested, and the samples were collected and cut into cross sections and the depth of corrosion was measured, as shown in Table 4 below.

TABLE 4

| | Corrosion Depth (mm) | | | | | | | | |
|---|---|---|---|---|---|---|---|---|---|
| | After 168 hours | | | After 336 hours | | | After 480 hours | | |
| | Test Piece 1 | Test Piece 2 | Average | Test Piece 1 | Test Piece 2 | Average | Test Piece 1 | Test Piece 2 | Average |
| Example 1 | 0.017 | — | 0.017 | 0.056 | 0.093 | 0.0745 | 0.06 | 0.058 | 0.059 |
| Comparative Example 2 | 0.042 | 0.01 | 0.026 | 0.06 | 0.07 | 0.065 | 0.035 | 0.075 | 0.055 |
| Comparative Example 3 | 0.012 | 0.03 | 0.021 | 0.075 | 0.045 | 0.06 | — | — | — |

Referring to Table 4 above, it was confirmed that the copper alloy tube of Example 1 having low phosphorus content had the best corrosion resistance in the salt spray test.

What is claimed is:

1. A copper alloy tube for a heat exchanger comprising an oxygen-free copper-tin alloy having: an oxygen (O) content of 5 ppm to up to 9.2 ppm, a composition satisfying the following conditional formulas (1) and (2), and not containing phosphorous, a thermal conductivity of 260 to 350 W/m·k, and an electrical conductivity of 65% IACS or more:

$$0.3 \text{ wt } \% \leq C_{sn} \leq 0.6 \text{ wt } \%, \quad (1)$$

$$0.01 \text{ wt } \% \leq C_{zn} < 1.0 \text{ wt } \%, \quad (2)$$

wherein $C_{sn}$ represents the content of tin in the oxygen-free copper-tin alloy, wherein $C_{zn}$ represents the content of zinc in the oxygen-free copper-tin alloy, and wherein the oxygen-free copper-tin alloy has a texture having a GOSS orientation distribution density of 4.5% or less.

2. The copper alloy tube of claim 1, wherein a tensile strength in a longitudinal direction of the tube is 260 MPa or more.

3. The copper alloy tube of claim 1, wherein the GOSS orientation distribution density is between 0.1 to 1.5%.

4. An alloy consisting of:

an oxygen (O) content of 5 ppm to up to but not including 9.2 ppm;

a tin (Sn) content of 0.3 wt % up to and including 0.6 wt %;

a phosphorus (P) content below 0.005 wt %;

a zinc (Zn) content of 0.01 wt % up to 1.0 wt %; and a Copper (Cu) content of a balance of the alloy;

wherein, when the alloy is formed into a tube, the tube exhibits a thermal conductivity of 260 to 350 W/m·k, an electrical conductivity of 65% IACS or more, and a GOSS orientation distribution density of 4.5% or less.

5. An alloy comprising:

an oxygen (O) content of 5 ppm to up to but not including 9.2 ppm;

a tin (Sn) content of 0.3 wt % up to and including 0.6 wt %;

a phosphorus (P) content below 0.005 wt %;

a zinc (Zn) content of more than 0.4 wt % up to 1.0 wt %; and a Copper (Cu) content of 98.395 wt % to 99.53 wt %;

wherein the alloy exhibits a thermal conductivity of 260 to 350 W/m·k, an electrical conductivity of 65% IACS or more, and a GOSS orientation distribution density of 4.5% or less when rolled into a tube via a rolling process with a rolling zone temperature of greater than and not including 600 degree Celsius up to 750 degrees Celsius.

6. A copper alloy tube for a heat exchanger comprising an oxygen-free copper-tin alloy having: an oxygen (O) content of 5 ppm to up to 7.1 ppm, a composition satisfying the following conditional formulas (1) and (2), and not containing phosphorous, a thermal conductivity of 260 to 350 W/m·k, and an electrical conductivity of 65% IACS or more:

$$0.3 \text{ wt } \% \leq C_{sn} \leq 0.6 \text{ wt } \%, \quad (1)$$

$$0.01 \text{ wt } \% \leq C_{zn} < 1.0 \text{ wt } \%, \quad (2)$$

wherein $C_{sn}$ represents the content of tin in the oxygen-free copper-tin alloy, wherein $C_{zn}$ represents the content of zinc in the oxygen-free copper-tin alloy, and wherein the oxygen-free copper-tin alloy has a texture having a GOSS orientation distribution density of 4.5% or less.

* * * * *